United States Patent [19]

Harsányi et al.

[11] Patent Number: 4,927,549

[45] Date of Patent: May 22, 1990

[54] LUBRICANT OF LUBRICATING OIL BASIS FOR LUBRICATING ROTATING AND/OR SLIDING SURFACES AND PROCESS FOR PREPARING SAME

[75] Inventors: József Harsányi, Budapest; László Kohányi, Százhalombatta; Károly Domsa, Budapest; Lajos Szakács, Budapest; Géza Szentgyörgyi, Budapest; Aladár Imre, Budapest, all of Hungary

[73] Assignee: Egis Gyogyszergyar, Budapest, Hungary

[21] Appl. No.: 204,254

[22] Filed: Jun. 9, 1988

[51] Int. Cl.[5] ..... C10M 125/10

[52] U.S. Cl. ..... 252/25; 252/49

[58] Field of Search ..... 252/25, 18, 49

[56] References Cited

U.S. PATENT DOCUMENTS

| | | | |
|---|---|---|---|
| 2,050,139 | 8/1936 | Wanamaker et al. | 252/25 |
| 3,150,087 | 9/1964 | Holzenger . | |
| 3,304,257 | 2/1967 | Schanzer | 252/25 |
| 4,626,365 | 12/1986 | Mori | 252/25 |
| 4,657,683 | 4/1987 | Davies | 252/25 |

*Primary Examiner*—Jacqueline V. Howard
*Assistant Examiner*—Margaret B. Medley
*Attorney, Agent, or Firm*—Keil & Weinkauf

[57] ABSTRACT

The invention relates to a lubricant of lubricating oil basis for lubricating rotating and/or sliding surfaces. Furthermore, the invention relates to a process for preparing this lubricant.

The lubricant according to the invention comprises, beside the usual additives, 0.01 to 0.3 g/l of aluminium oxide power consisting of particles of 0.1 to 4 μm in size.

6 Claims, No Drawings

LUBRICANT OF LUBRICATING OIL BASIS FOR LUBRICATING ROTATING AND/OR SLIDING SURFACES AND PROCESS FOR PREPARING SAME

The invention relates to a lubricant of lubricating oil basis for lubricating rotating and sliding surfaces. Furthermore the invention relates to a process for preparing such lubricants.

It is known that for the lubrification of internal combustion egines and rotating/sliding machine parts, lubricating oils are used which ensure the appropriate lubricating capacity in the desired temperature range.

When using the known motor oils for lubrification in an internal combustion engine, a turbulent flow is characteristic of the oil film boundary layers of 5 to 20 μm in thickness between the surfaces sliding on each other, because of a low roughness of the metal surfaces. Thus, a means of improving the efficiency of engines consists in shifting the turbulent flow in the lubricating oil layer towards the laminar flow, e.g. by using additives [Graue and Lückenath, Schmiertechnik 2, 71 (1985)].

Various additives are used to improve the lubricating properties, durability and the like of lubricating oils; thus, the commonly used lubricating oils contain detergents, antioxidants, corrosion inhibitors, anti-wear and anti-friction agents, pour-point depressors and anti-foam agents as additives.

Furthermore, there are known additives providing the lubrification of friction surfaces also under extreme working conditions (e.g. on cold-starting). Such a substance is e.g. molybdenum disulfide decreasing the friction as a solid but soft lubricant.

In general, a further priority requirement against lubricating oils is that they may not contain solid contaminations [Seifert and Wertcott: Wear 21, 47–52 (1979)].

The aim of the present invention is to provide a cheap lubricant decreasing the wear of rotating and/or sliding surfaces as well as increasing the efficiency of combustion in internal combustion engines.

The invention is based on the recognition that the above aim can completely be achieved with the aid of a lubricant containing, beside the usual components of lubricating oils, aluminium oxide of a particle size below 4 μm.

Furthermore, the invention is based on the recognition that, although larger solid particles should by all means be removed for abolishing their harmful wearing effect, the friction power loss of machines and engines can strongly be diminished by introducing heat- and wear-resistant high-strength particles with a size of 0.1 to 4 μm, preferably 0.2 to 2.5 μm. Namely, we have found that solid particles smaller than 2.5 μm in diameter do not exert any abrasive effect but fill the surface unevennesses of a few μm in depth always being present as a consequence of the friction of moving surfaces. Thereby, superfinished surfaces are actually formed and when they are displaced in relation to each other, the turbulent flow otherwise characteristic of the boundary layer is moderated in the oil film because the flow type is shifted towards laminarity, whereby the friction resistance in the machine or engine is decreased. In addition, a lubricating film is formed on the surfaces by the particles smaller than 1 μm. As a result, the internal mechanical efficiency of the machine or engine is enhanced and the fuel consumption is decreased by 4 to 8%.

It is surprising for one skilled in the art that a decrease in the wear and fuel consumption is resulted from the presence in the oil of heat- and wear-resistant solid particles of 0.1 to 4 μm in size a commonly accepted rule is to prevent the incorporation of solid particles, causing an enhanced rate of wear of the machine, into oils during the operation of machines and internal combustion engines. Therefore, the floating particles are continuously removed from the oil by an oil filter under operation. (Usually, the oil filters are suitable to remove solid particles larger than 5 to 10 μm.)

Finally, the invention is based on the recognition that the presence of aluminium oxide ($Al_2O_3$) results not only in the above "superfinishing action" in the case of internal combustion engines but the combustion of carbon monoxide is also also catalyzed by this compound, whereby the efficiency of combustion in the engine is improved and the carbon monoxide content of the exhaust gases is decreased.

Thus, the invention relates to a lubricant of lubricating oil basis comprising, beside the usual additives of lubricating oils, 0.01 to 0.3 g/l, preferably 0.02 to 0.2 g/l, of aluminium oxide ($Al_2O_3$) powder consisting of particles of 0.1 to 4 μm, preferably 0.2 to 2.5 μm, in size.

The base material of the lubricant according to the invention may be any lubricating oil such as solvented distillate of spindle oil, machine oil, hydraulic oil freed from paraffines as well as refined synthetic oils.

The lubricant according to the invention is prepared by mixing 0.01 to 0.3 g/l, preferably 0.02 to 0.2 g/l, of aluminium oxide ($Al_2O_3$) powder having a particle size of 0.1 to 4 μm, preferably 0.2 to 2.5 μm, to a commonly used lubricating oil. The particles of the aluminium oxide may be mixed to the lubricating oil separately or together with the usual additives.

The sedimentation of the aluminium oxide particles is prevented by the consistency, the volume/surface ratio and the surface tension of the lubricant according to the invention whereby the particles are not removed by the oil filter.

The use of the lubricant according to the invention results in a fuel saving of 4 to 8%. Besides, the useful life of the internal combustion engine is also significantly increased because of the lower wear, and the oil consumption is also diminished.

The decrease in the carbon monoxide content of the exhaust gases is an important result from the aspect of environmental protection, too.

The lubricating oils according to the invention can preferably be used:

in internal combustion (Otto and Diesel) engines, owing to a decrease in their fuel consumption and an increase in their life;

in gear transmissions (speed-change boxes, differential gears, industrial transmission machineries), owing to an improvement in their efficiency; and in metal rolling and calendering as well as wire-drawing, owing to a decrease in their power demand.

The invention is further illustrated by the aid of the following non-limiting Examples.

EXAMPLES 1

0.03 g of previously dried aluminium oxide with a particle size of 0.1 to 1.0 μm was added to 3.75 liters of multisuper oil. By mechanical stirring a homogeneous suspension was formed from this mixture, and at the occasion of an oil change, the thus obtained oil was filled into the four-cycle, four-cylinder, Otto-type 1200

$cm^3$ engine of a 2 years old LADA 1200 type passenger car. A specific gasoline consumption of 5.8 to 6.2 liters/100 km was achieved when this car ran with 4 passengers at a speed of 85 km/h on a plane way under no-wind conditions. Earlier, under the same conditions, the specific gasoline consumption amounted to 6.8 to 7.5 liters/100 kg by using a similar motor oil without aluminium oxide additive.

The car investigated ran a distance of 12,000 km within one year on various ways and under different load conditions, without oil change. The one-year fuel saving amounted to 5.6% as compared to the average of the first two years.

At the oil change following the one-year test running period, 100 ml of the motor oil were drained from the oil sump. This oil was a slightly opalescent, brown liquid depositing a thin, white layer after a sedimentation period of 5 days which, however, was immediately distributed by stirring up. During the 12,000 km run, about 0.4 liter of oil was consumed.

Thus it is obvious that the lubricant according to the invention provides high economical advantages.

EXAMPLES 2

The friction between solid surfaces is modified by the aluminium oxide additive. Therefore, experiments were arranged in order to develop a mixed friction state on the friction surfaces during test. Investigations were carried out by using a 4-ball SETA-SHELL equipment (DIN 51350) with 3 different loads.

On the basis of evaluating the results of these investigations, the load characterizing the start of the seizure was significantly increased as compared to the base oil, and showed a maximum at a concentration of 0.2 g/l of aluminium oxide which means an increase by 65%. The friction-diminishing effect by 7 to 25% of the solid additive could be detected with each of the three loads.

EXAMPLE 3

Comparative examination of the compounded oils according to the invention was carried out also in a TIMKEN type friction- and wear-testing equipment (ASTM D-2882). It was found that the friction coefficient was descreased by about 7% as compared to the base oil; simultaneously, the ring-wear was also significantly diminished whereas the width of the wear and wear trace on the test piece was unchanged.

EXAMPLE 4

Multisuper oil filled in the engine of a LADA 1200 passenger car as described in Example 1 was tested on a test stand by using aluminium oxide additive in a concentration of 0.2 g/liter. As a result of the comparative measurements, it was found that an average fuel saving by 5 to 7% could be achieved whereas 11% were measured in the transitional loading region of the engine.

EXAMPLE 5

Multisuper lubricating oil was tested by using aluminium oxide additive in a concentration of 0.02 g/liter also in a PETTER W1 type test engine (IP 176/69, 144-hour AGIP test). The particle size of the additive used amounted to 0.1 to 2.5 μm. It was found that the oil consumption was not changed as compared to the reference standard. Similarly, no considerable difference was observed in the wear of the piston rings and the connecting rod bearing, however, the extent of the increase in the output between 4% and 7% was found to be 5.5% as an average. The comparative analyses of the carbon monoxide content of the exhaust gases revealed that the carbon monoxide emission decreased by 10 to 30%.

We claim:

1. Lubricant of lubricating oil basis for lubricating rotating and/or sliding surfaces, which comprises, beside the usual additives of lubricating oils, 0.01 to 0.3 g/l of aluminium oxide powder consisting of particles of 0.1 to 4 μm in size.

2. A lubricant as claimed in claim 1, which comprises 0.02 to 0.2 g/l of aluminium oxide.

3. A lubricant as claimed in claim 1, wherein the aluminium oxide consists of particles of 0.02 to 2.5 μm in size.

4. A process for preparing the lubricant as claimed in claim 1, which comprises mixing 0.01 to 0.3 g/l of aluminium oxide powder having a particle size of 0.1 to 4 μm to a commonly used lubricating oil.

5. A process as claimed in claim 4, which comprises using 0.01 to 0.2 g/l of aluminium oxide having a particle size of 0.02 to 2.5 μm.

6. A process as claimed in claim 4, wherein the aluminium oxide is mixed to the lubricating oil together with the usual oil additives.

* * * * *

UNITED STATES PATENT AND TRADEMARK OFFICE

CERTIFICATE OF CORRECTION

PATENT NO. : 4,927,549

DATED : May 22, 1990

INVENTOR(S) : Jozsef HARSANYI et al.

It is certified that error appears in the above-identified patent and that said Letters Patent is hereby corrected as shown below:

IN THE CLAIMS

Claim 5, Column 4, Line 42

"using 0.01 to 0.2 g/l" should read

--using 0.02 to 0.2 g/l--

Signed and Sealed this

Thirtieth Day of July, 1991

*Attest:*

*Attesting Officer*

HARRY F. MANBECK, JR.

*Commissioner of Patents and Trademarks*